US007014739B2

(12) United States Patent
Lin et al.

(10) Patent No.: US 7,014,739 B2
(45) Date of Patent: Mar. 21, 2006

(54) CONVEX PROFILE ANODE FOR ELECTROPLATING SYSTEM

(75) Inventors: Tro-Hsu Lin, Taichung (TW); Tien-Chen Hu, Pingtung (TW); Hong-Jin Pu, Pingtung (TW); Zhi-Zan Zhuang, Kaohsiung (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 445 days.

(21) Appl. No.: 10/159,374

(22) Filed: May 30, 2002

(65) Prior Publication Data

US 2003/0221958 A1 Dec. 4, 2003

(51) Int. Cl.
*C25D 17/00* (2006.01)

(52) U.S. Cl. ..... 204/225; 204/280; 204/292

(58) Field of Classification Search ..... 204/225, 204/280, 292, 297.06, 297.01; 205/292
See application file for complete search history.

(56) References Cited

U.S. PATENT DOCUMENTS 5,443,707 A * 8/1995 Mori ..... 204/242
6,113,759 A * 9/2000 Uzoh ..... 205/157
6,391,168 B1 * 5/2002 Ueno ..... 204/242

* cited by examiner

*Primary Examiner*—Bruce F. Bell
(74) *Attorney, Agent, or Firm*—Tung & Assoc.

(57) ABSTRACT

An electroplating anode including a substantially convex oxidizing surface for oxidation of metal atoms in a semiconductor wafer electroplating process. The electroplating anode of the present invention substantially prolongs the lifetime of the anode and contributes to the prevention of wafer contamination due to generation of potential wafer-contaminating precipitate particles during a wafer electroplating process.

13 Claims, 2 Drawing Sheets

CONVEX PROFILE ANODE FOR ELECTROPLATING SYSTEM

FIELD OF THE INVENTION

The present invention relates to electroplating systems used in the deposition of metal layers on semiconductor wafer substrates in the fabrication of semiconductor integrated circuits. More particularly, the present invention relates to an anode having a convex profile which prevents buildup of potential wafer-contaminating precipitate or sludge on the anode and significantly prolongs the lifetime of the anode in an electroplating system.

BACKGROUND OF THE INVENTION

In the fabrication of semiconductor integrated circuits, metal conductor lines are used to interconnect the multiple components in device circuits on a semiconductor wafer. A general process used in the deposition of metal conductor line patterns on semiconductor wafers includes deposition of a conducting layer on the silicon wafer substrate; formation of a photoresist or other mask such as titanium oxide or silicon oxide, in the form of the desired metal conductor line pattern, using standard lithographic techniques; subjecting the wafer substrate to a dry etching process to remove the conducting layer from the areas not covered by the mask, thereby leaving the metal layer in the form of the masked conductor line pattern; and removing the mask layer typically using reactive plasma and chlorine gas, thereby exposing the top surface of the metal conductor lines. Typically, multiple alternating layers of electrically conductive and insulative materials are sequentially deposited on the wafer substrate, and conductive layers at different levels on the wafer may be electrically connected to each other by etching vias, or openings, in the insulative layers and filling the vias using aluminum, tungsten or other metal to establish electrical connection between the conductive layers.

Deposition of conductive layers on the wafer substrate can be carried out using any of a variety of techniques. These include oxidation, LPCVD (low-pressure chemical vapor deposition), APCVD (atmospheric-pressure chemical vapor deposition), and PECVD (plasma-enhanced chemical vapor deposition). In general, chemical vapor deposition involves reacting vapor-phase chemicals that contain the required deposition constituents with each other to form a nonvolatile film on the wafer substrate. Chemical vapor deposition is the most widely-used method of depositing films on wafer substrates in the fabrication of integrated circuits on the substrates.

Due to the ever-decreasing size of semiconductor components and the ever-increasing density of integrated circuits on a wafer, the complexity of interconnecting the components in the circuits requires that the fabrication processes used to define the metal conductor line interconnect patterns be subjected to precise dimensional control. Advances in lithography and masking techniques and dry etching processes, such as RIE (Reactive Ion Etching) and other plasma etching processes, allow production of conducting patterns with widths and spacings in the submicron range. Electrodeposition or electroplating of metals on wafer substrates has recently been identified as a promising technique for depositing conductive layers on the substrates in the manufacture of integrated circuits and flat panel displays. Such electrodeposition processes have been used to achieve deposition of the copper or other metal layer with a smooth, level or uniform top surface. Consequently, much effort is currently focused on the design of electroplating hardware and chemistry to achieve high-quality films or layers which are uniform across the entire surface of the substrates and which are capable of filling or conforming to very small device features. Copper has been found to be particularly advantageous as an electroplating metal.

Electroplated copper provides several advantages over electroplated aluminum when used in integrated circuit (IC) applications. Copper is less electrically resistive than aluminum and is thus capable of higher frequencies of operation. Furthermore, copper is more resistant to electromigration (EM) than is aluminum. This provides an overall enhancement in the reliability of semiconductor devices because circuits which have higher current densities and/or lower resistance to EM have a tendency to develop voids or open circuits in their metallic interconnects. These voids or open circuits may cause device failure or burn-in.

FIG. 1 schematically illustrates a typical standard or conventional electroplating system 10 for depositing copper onto a semiconductor wafer 18. The electroplating system 10 includes a standard electroplating cell having an adjustable current source 12, a bath container 14, a copper anode 16 and a cathode 18, which cathode 18 is the semiconductor wafer that is to be electroplated with copper. The anode 16 and semiconductor wafer/cathode 18 are connected to the current source 12 by means of suitable wiring 38. The bath container 14 holds a bath 20 typically of acid copper sulfate solution which may include an additive for filling of submicron features and leveling the surface of the copper electroplated on the wafer 18.

As illustrated in FIGS. 1 and 2, the electroplating system 10 typically further includes a pair of bypass filter conduits 24 which extend through the anode 16 and open to the upper, oxidizing surface 22 of the anode 16 through respective sludge openings 26 at opposite ends of the anode 16. The bypass filter conduits 24 connect to a bypass pump/filter 30 located outside the bath container 14, and the bypass pump/filter 30 is further connected to an electrolyte holding tank 34 through a tank inlet line 32. The electrolyte holding tank 34 is, in turn, connected to the bath container 14 through a tank outlet line 36.

In operation of the electroplating system 10, the current source 12 applies a selected voltage potential typically at room temperature between the anode 16 and the cathode/wafer 18. This potential creates a magnetic field around the anode 16 and the cathode/wafer 18, which magnetic field affects the distribution of the copper ions in the bath 20. In a typical copper electroplating application, a voltage potential of about 2 volts may be applied for about 2 minutes, and a current of about 4.5 amps flows between the anode 16 and the cathode/wafer 18. Consequently, copper is oxidized typically at the oxidizing surface 22 of the anode 16 as electrons from the copper anode 16 and reduce the ionic copper in the copper sulfate solution bath 20 to form a copper electroplate (not illustrated) at the interface between the cathode/wafer 18 and the copper sulfate bath 20.

The copper oxidation reaction which takes place at the oxidizing surface 22 of the anode 16 is illustrated by the following reaction formula (1):

$$Cu \rightarrow Cu^{++} + 2e^- \quad (1)$$

The oxidized copper cation reaction product forms ionic copper sulfate in solution with the sulfate anion in the bath 20:

$$Cu^{++} + SO_4^{--} \rightarrow Cu^{++}SO_4^{--} \quad (2)$$

At the cathode/wafer 18, the electrons harvested from the anode 16 flowed through the wiring 38 reduce copper cations in solution in the copper sulfate bath 20 to electroplate the reduced copper onto the cathode/wafer 18:

$$Cu^{++}+2e^{-}\rightarrow Cu \quad (3)$$

As the anode 16 is consumed during the electroplating process, small quantities of solid copper sulfate or "anode fines" tend to precipitate at the interface between the copper sulfate bath 20 and the oxidizing surface 22 of the anode 16 to form a copper precipitate or sludge 28 on the oxidizing surface 22, as illustrated in FIG. 2.

Various problems can be caused by the sludge 28 on the anode 16. For example, the sludge 28 may cause a voltage drop in the electroplating cell because oxidixed copper ions must migrate through the sludge in order to reach the bath solution 20. The sludge 28 may also affect deposit uniformity of the copper on the wafer 18. Additionally, the anode sludge 28 can be the source of potential wafer-contaminating particles which may contaminate the copper plated onto the wafer 18.

Copper sludge 28 can normally be effectively removed from the oxidizing surface 22 by operation of the bypass pump/filter 30, wherein the bath solution 20 is continually drawn through the sludge openings 26 of the anode 16 and to the electrolyte holding tank 34 through the bypass filter conduits 24, bypass pump/filter 30 and tank inlet line 32, respectively. The bypass pump/filter 30 removes the particulate precipitate/sludge 28 from the bath solution 20 before entry of the bath solution 20 into the electrolyte holding tank 34. The filtered bath solution 20 is typically distributed from the electrolyte holding tank 34 back into the bath container 14 through a tank outlet line 36 to replenish the supply of the bath solution 20 in the bath container 14.

As further illustrated in FIG. 2, in its original condition the anode 16 is typically rectangular in cross-section and has a uniformly flat oxidizing surface 22. During prolonged use of the anode 16 in the electroplating system 10, however, copper from the oxidizing surface 22 of the anode 16 is oxidized and enters the copper sulfate solution in the bath 20, as indicated by reactions (1) and (2), respectively, above. Consequently, as the copper is gradually removed from the oxidizing surface 22 of the anode 16, the oxidizing surface 22 gradually assumes a concave profile, as illustrated in FIG. 3. The sludge 28 tends to accumulate on the concave oxidizing surface 22, as illustrated in FIG. 3, and is more difficult to remove from the concave oxidizing surface 22 than from the relatively flat oxidizing surface 22. Accordingly, small particles from the sludge 28 may break off and enter the bath 20 and potentially contaminate the wafer 18 during the electroplating process. Consequently, the concave anodes 16 must be frequently replaced during periods of frequent usage of the electroplating system 10.

Accordingly, an electroplating anode is needed which is more resistant to concave profiling during prolonged wafer electroplating and which extends the lifetime of the anode in the electroplating system.

SUMMARY OF THE INVENTION

An object of the present invention is to provide an anode for use in an electroplating system and which is characterized by extended lifetime.

Another object of the present invention is to provide an anode which is capable of substantially preventing contamination of work-in-progress (WIP) semiconductor wafers by precipitate particles generated during an electroplating process.

Still another object of the present invention is to provide an electroplating anode which is more resistant to concave profiling over prolonged periods of electroplating in the processing of semiconductor wafers.

Yet another object of the present invention is to provide an electroplating anode which at least doubles the anode lifetime during electroplating of metals on a wafer substrate in the fabrication of semiconductor integrated circuits on the substrate.

A still further object of the present invention is to provide an electroplating anode which is constructed with a substantially convex configuration on the oxidizing surface thereof to at least double the useful lifetime of the anode.

Yet another object of the present invention is to provide a method for preventing contamination of WIP integrated circuits on semiconductor wafer substrates by precipitate particles during a wafer electroplating process.

Still another object of the present invention is to provide a method for significantly prolonging the useful lifetime of an electroplating anode in an electroplating system for semiconductors.

In accordance with these and other objects and advantages, the present invention comprises an electroplating anode including a substantially convex oxidizing surface for oxidation of metal atoms in a semiconductor wafer electroplating process. The electroplating anode of the present invention substantially prolongs the lifetime of the anode and contributes to the prevention of wafer contamination due to generation of potential wafer-contaminating precipitate particles during a wafer electroplating process.

BRIEF DESCRIPTION OF THE DRAWINGS

The invention will now be described, by way of example, with reference to the accompanying drawings, wherein.

DESCRIPTION OF THE PREFERRED EMBODIMENTS

When used herein, the term, "metal anode body" means an anode body constructed of a magnetic or non-magnetic metal suitable for electroplating purposes and including but not limited to gold, silver, aluminum, zinc, cadmium, iron, nickel or chromium. When used herein, the term "convex" means any arched, bulging, protruding, raised or rounded surface or any non-concave and non-planar surface.

Figure 4:
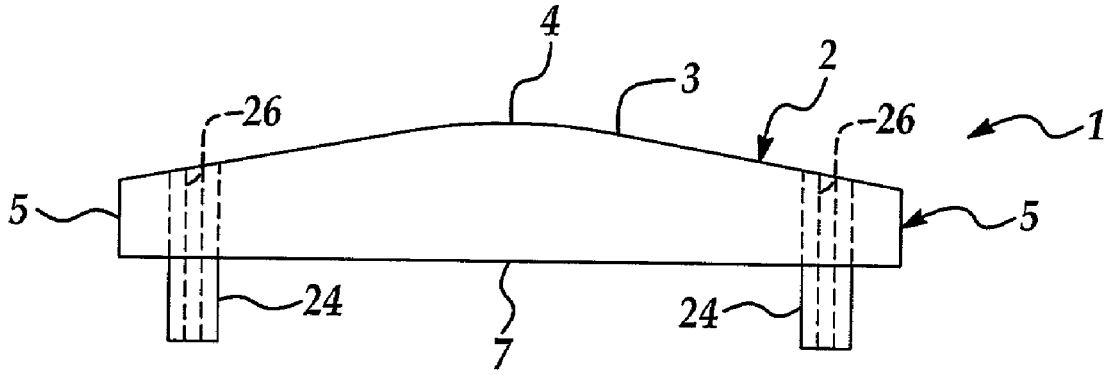
FIG. 4 is a side view of a convex profile electroplating anode of the present invention.

Referring to FIG. 4 of the drawings, an illustrative embodiment of the convex profile electroplating anode of the present invention is generally indicated by reference numeral 1. The convex anode 1 includes an anode body 2 typically constructed of soluble CuP for copper electroplating applications, although the anode body 2 may alternatively be constructed of other magnetic or non-magnetic metals including gold, silver, aluminum, zinc, cadmium, iron, nickel or chromium, in non-exclusive particular, depending upon the desired electroplating application. The anode body 2 typically includes a flat bottom surface 7 and a continuous, annular side surface 5, although the anode body 2 may have alternative configurations. An upper, oxidizing surface 3 of the anode body 2 has a convex, arched, bulging, protruded, rounded or raised profile or configuration when the anode body 2 is viewed from the side or in cross-section, and the anode body 2 is typically thickest at a center apex 4 of the oxidizing surface 3, which tapers downwardly from the center apex 4 to the circumscribing side surface 5 the center apex 4 may be or curved, as illustrated, or truncated, and the oxidizing surface 3 may angle or curve gradually or sharply from the center apex 4. Accordingly, that portion of the anode body 2 between the bottom surface 7 and the center apex 4 of the oxidizing surface 3 is typically at least as thick as that portion of the anode body 2 at the side surface 5. The convex profile of the oxidizing surface 3 may be casted into the anode body 2 or shaped in the anode body 2 according to methods which are known by those skilled in the art. As illustrated in FIG. 4, a pair of bypass filter conduits 24 typically extends through the anode body 2 adjacent to respective edges thereof, and each bypass filter conduit 24 includes a sludge opening 26 which opens onto the oxidizing surface 3 of the anode body 2.

Figure 1:
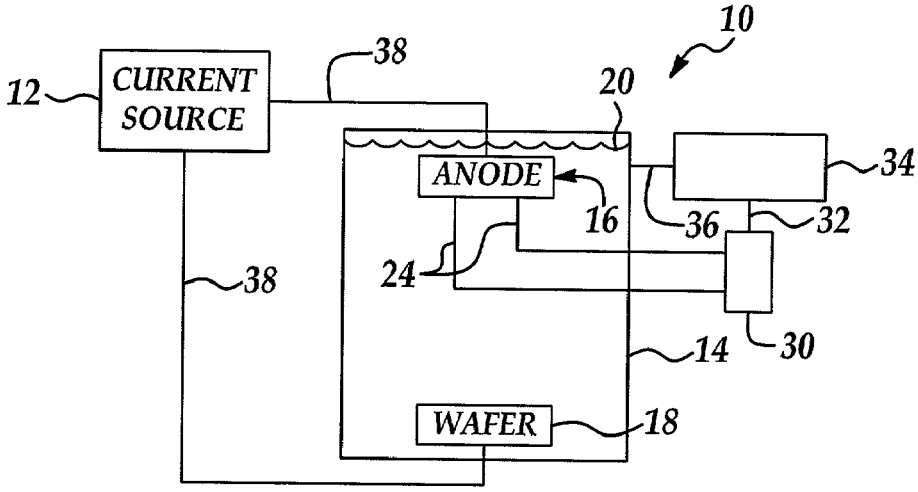
Figure 1 Prior Art
FIG. 1 is a schematic view of a typical standard or conventional electroplating system for semiconductors suitable for implementation of the present invention.
Figure 2:
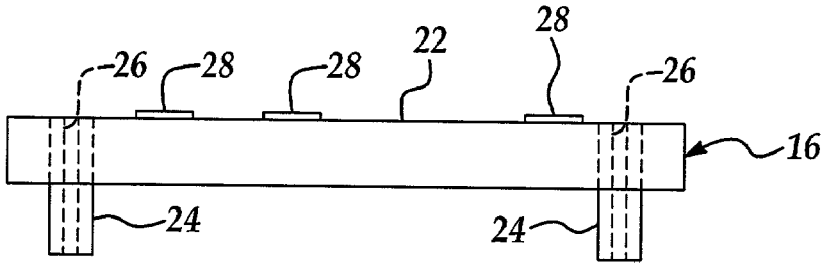
Figure 2 Prior Art
FIG. 2 is a side view of a typical standard or conventional anode used in an electroplating system for semiconductors, with the anode in a relatively new or unused condition.
Figure 3:
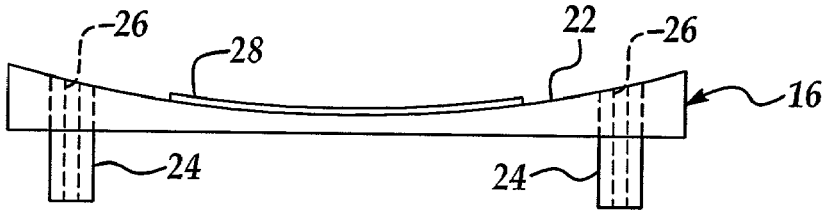
Figure 3 Prior Art
FIG. 3 is a side view of a standard or conventional anode, after prolonged use, more particularly illustrating a concave profile of the anode.
Figure 5:
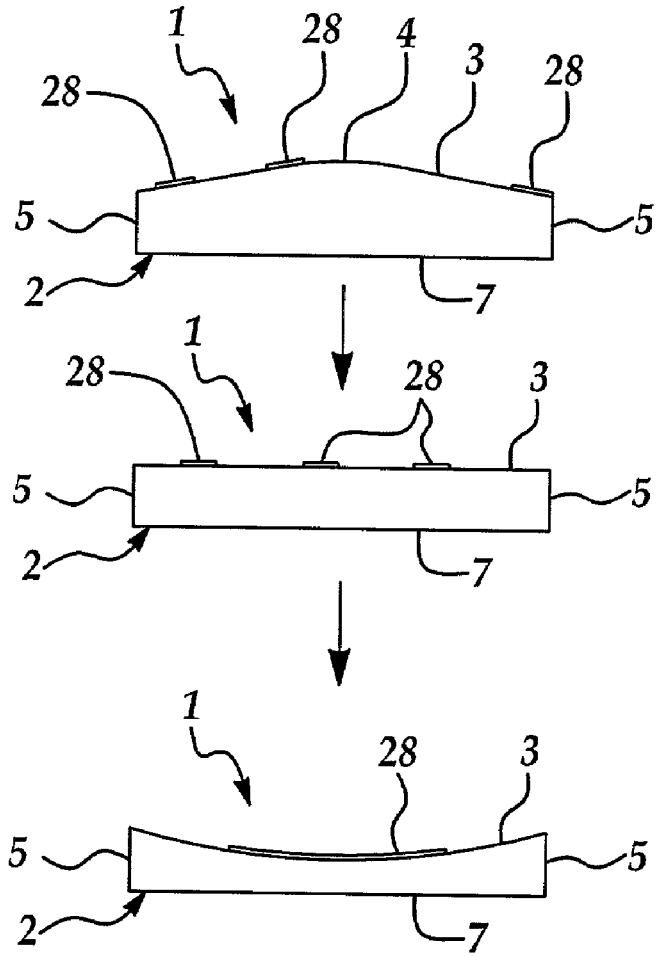
FIG. 5 is a flow diagram illustrating a typical progression in anode profiles during prolonged use of the convex electroplating anode of the present invention.

Referring next to FIGS. 1, 4 and 5 of the drawings, in typical application the convex anode 1 of the present invention is positioned in a bath solution 20 containing the metal cation in electrolyte solution with a cation such as sulfate or phosphate. For a copper electroplating process, the bath solution 20 may be acidic copper sulfate. The current source 12 is connected to the anode 1 and to the cathode/wafer 18, and as the voltage potential is applied by the current source 12 between the anode 16 and the cathode/wafer 18, copper on the anode 16 is oxidized at the convex upper oxidizing surface 3 of the anode body 2 as the copper cations dissociate from the oxidizing surface 3 and enter the bath solution 20. The electrons harvested from the anode body 2 reduce the copper cations in the copper sulfate solution to electroplate copper atoms onto the cathode/wafer 18 at the interface of the cathode/wafer 18 and the bath 20. Any sludge 28 forming on the upper, oxidizing surface 3 of the anode body 2 slides down the sloped oxidizing surface 3, through the respective sludge openings 26 in the oxidizing surface 3 and into the bypass filter conduits 24, which conduct the copper precipitate/sludge 28 through the bypass pump/filter 30 and to the electrolyte holding tank 34 for re-entry into the bath container 14.

After a prolonged period of electroplating, the oxidizing surface 3 of the anode body 2 assumes a substantially straight profile, as illustrated in the middle diagram of FIG. 5, due to sustained oxidation and removal of copper from the oxidizing surface 3. At this point, the anode 1 is still useful for continued electroplating, since sludge 28 can still be effectively removed from the oxidizing surface 3 via constant suction applied through the sludge openings 26 by operation of the bypass pump/filter 30. Continued electroplating, however, eventually generates a concave profile on the oxidizing surface 3 due to the sustained copper oxidation and removal, and the sludge 28 has a tendency to accumulate in the concave ozidizing surface 3 at a faster rate than the sludge 28 can be removed from the oxidizing surface 3 by operation of the bypass pump/filter 30. At that point, the anode 1 is removed from the electroplating system 10 and replaced by a new, concave anode 1 for continued electroplating.

While the preferred embodiments of the invention have been described above, it will be recognized and understood that various modifications can be made in the invention and the appended claims are intended to cover all such modifications which may fall within the spirit and scope of the invention.

What is claimed is:

1. An anode for an electroplating system, comprising:

a metal anode body;

a substantially convex oxidizing surface provided on said anode body; and a pair of bypass filter conduits carried by said anode body and a pair of sludge openings provided in said oxidizing surface and communicating with said pair of bypass filter conduits, respectively.

2. The anode of claim 1 wherein said metal comprises copper.

3. An anode for an electroplating system, comprising:

a metal anode body;

a substantially convex oxidizing surface provided on said anode body; and wherein said anode body comprises a substantially flat bottom surface spaced from said oxidizing surface and an annular side surface substantially circumscribing said oxidizing surface and wherein said oxidizing surface defines a top surface of said anode body, wherein said anode body further comprises a pair of sludge openings provided in said oxidizing surface and communicating with a pair of bypass filter conduit, respectively.

4. The anode of claim 3 wherein said metal comprises copper.

5. The anode of claim 4 further comprising a pair of bypass filter conduits carried by said anode body and a pair of sludge openings provided in said oxidizing surface and communicating with said pair of bypass filter conduits, respectively.

6. An anode for an electroplating system, comprising:

a metal anode body comprising a substantially convex oxidizing surface having a center apex;

a side surface substantially circumscribing said oxidizing surface; and wherein said anode body at said center apex of said oxidizing surface is at least about twice as thick as said anode body at said side surface, and wherein said anode body further comprises a pair of bypass filter conduits carried by said anode body and a pair of sludge openings provided in said oxidizing surface and communicating with said pair of bypass filter conduits, respectively.

7. The anode of claim 6 wherein said metal comprises copper.

8. The anode of claim 7 further comprising a pair of bypass filter conduits carried by said anode body and a pair of sludge openings provided in said oxidizing surface and communicating with said pair of bypass filter conduits, respectively.

9. A method of increasing longevity of an anode having an anode body in an electroplating system, said method comprising the step of:

providing a substantially convex oxidizing surface on said anode body; and providing a pair of bypass filter conduits on said anode body and providing a pair of sludge openings in said oxidizing surface in communication with said pair of bypass filter conduits, respectively.

10. The method of claim 9 further comprising the step of constructing said anode body out of copper.

11. A method of increasing longevity of an anode having an anode body in an electroplating system, said method comprising the step of:

providing a substantially convex oxidizing surface on said anode body;

providing a side surface of said anode body in substantially circumscribing relationship to said oxidizing surface, providing a center apex in said oxidizing surface and constructing said anode body at least about twice as thick at said center apex as at said side surface, and providing a pair of bypass filter conduits on said anode body and providing a pair of sludge openings in said oxidizing surface in communication with said paid of bypass filter conduits, respectively.

12. The method of claim 11 further comprising the step of constructing said anode body out of copper.

13. The method of claim 11 further comprising the step of constructing said anode body out of copper.

* * * * *